US006964402B2

(12) United States Patent
Savalas

(10) Patent No.: US 6,964,402 B2
(45) Date of Patent: Nov. 15, 2005

(54) HOLDER FOR MULTIPLE DOCUMENTS

(75) Inventor: Julie Savalas, 9463 Olympia Dr., Eden Prairie, MN (US) 55347

(73) Assignee: Julie Savalas, Alpharetta, GA (US)

( * ) Notice: Subject to any disclaimer, the term of this patent is extended or adjusted under 35 U.S.C. 154(b) by 0 days.

(21) Appl. No.: 10/795,780

(22) Filed: Mar. 8, 2004

(65) Prior Publication Data

US 2005/0194511 A1 Sep. 8, 2005

(51) Int. Cl.[7] ..... A47B 19/00
(52) U.S. Cl. ..... 248/441.1; 40/124.4
(58) Field of Search ..... 248/458, 441.1, 248/450; 40/606.12, 611.01, 124.4, 729; D19/75, 77, 90; 211/45

(56) References Cited

U.S. PATENT DOCUMENTS 165,500 A * 7/1875 Patton ..... 248/458
732,828 A * 7/1903 Christopher ..... 248/450
D161,840 S * 2/1951 Hopp ..... D19/25
3,987,566 A * 10/1976 March ..... 40/124.4
D328,314 S * 7/1992 MacEwan ..... D19/91
5,413,305 A * 5/1995 Leeb ..... 248/460
5,603,175 A * 2/1997 Brenner ..... 40/124.4
5,722,628 A * 3/1998 Menaged ..... 248/441.1
5,911,328 A * 6/1999 Shampo ..... 211/40
5,911,398 A * 6/1999 VanLandingham, Jr. . 248/441.1
5,974,707 A * 11/1999 Kowalczyk ..... 40/124.4
D442,392 S * 5/2001 Follman et al. ..... D6/467
6,446,929 B1 * 9/2002 Scott et al. ..... 248/458

* cited by examiner

*Primary Examiner*—Ramon O Ramirez
(74) *Attorney, Agent, or Firm*—Schwegman, Lundberg, Woessner & Kluth, P.A.

(57) ABSTRACT

A pyramidal desktop document holder has banks of curved and tilted slots on each of the slant edges. The curved slots prevent the documents from bending over, falling sideways, and interfering with each other. A rotation mechanism may allow the holder body to rotate for viewing documents in other banks.

22 Claims, 7 Drawing Sheets

HOLDER FOR MULTIPLE DOCUMENTS

TECHNICAL FIELD

The present invention relates to document holders, and more particularly concerns tabletop or desktop holders for organizing and displaying multiple documents or sheets of material.

BACKGROUND

Who has not come upon a desk, table, or counter strewn with letters, notes, cards, or other documents that all need to be in view at once? Not the whole document, but at least enough of each one to remind us, as we go about other tasks, that something else needs our attention at some point before the documents get buried, or perhaps accidentally thrown away or mixed in with other papers.

Upright copy stands and typing holders can keep one document at a time in view. However, multiple stands would require far too much space, and we don't need to see the entire document for many purposes.

Recently, small hemispherical globes have appeared on the market for holding single documents. These globes are weighted and have a single curved slot for gripping the bottom of a document. They hold a flexible document such as a sheet of paper upright by forcing it to curve in a vertical direction, as one might press the bottom of a sheet between thumb and fingers to stiffen it against flopping down.

These globes are handy for desktop use, but multiple documents still take up far too much desk space if a number of them need to be kept in view at all times, but a partial view of each would suffice to cue their meaning or relative importance.

Presently available holders for displaying multiple flexible documents, such as paper that cannot stand unaided, seem to be overly large, and to require far too much space on a desk, table, counter, or similar horizontal surface. They also suffer from an unstated assumption that nothing less than a full view of the document would be acceptable for all purposes.

DETAILED DESCRIPTION

Figure 1:
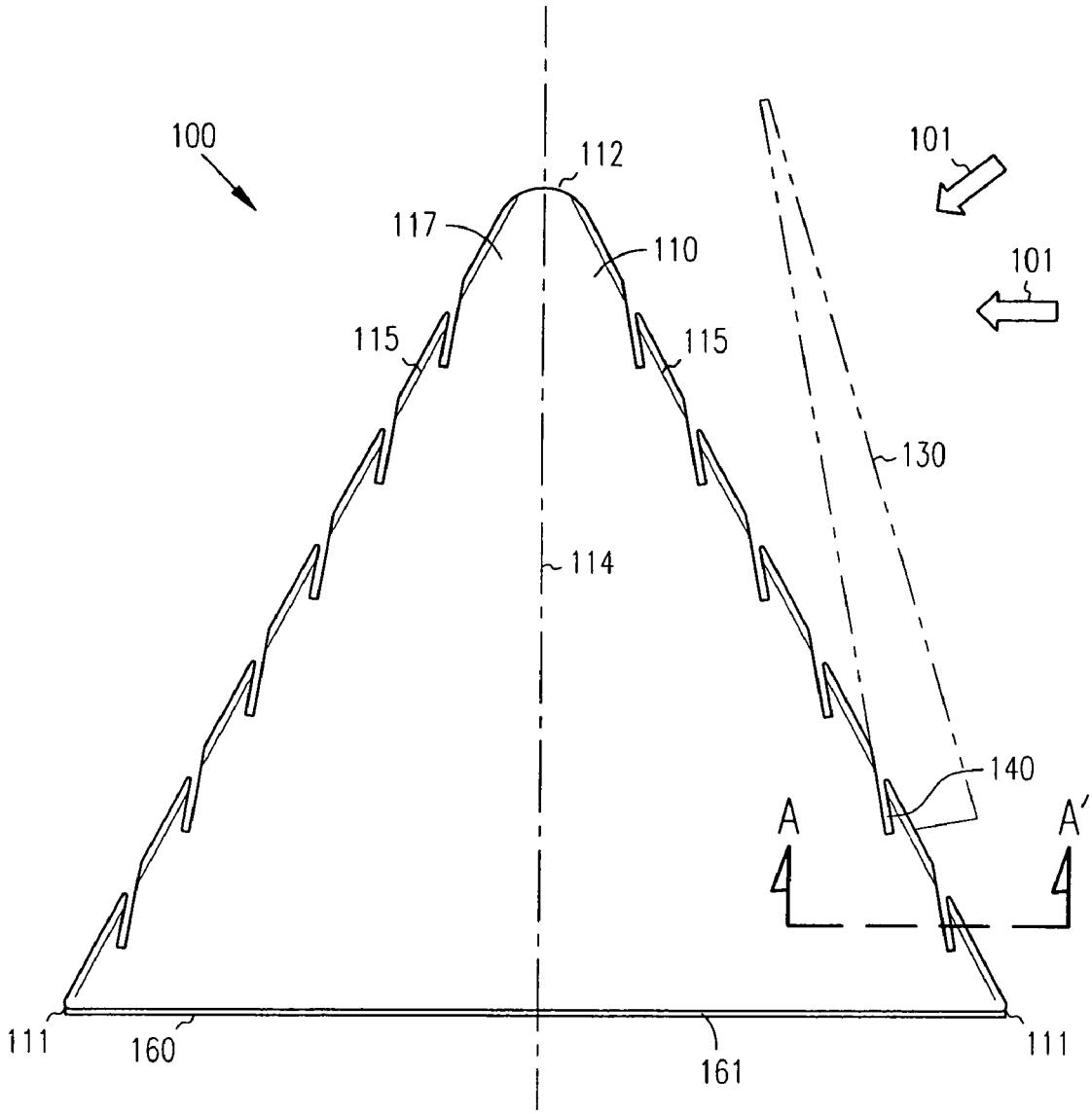
FIG. 1 is an elevation of a document holder according to an embodiment of the invention.
Figure 2:
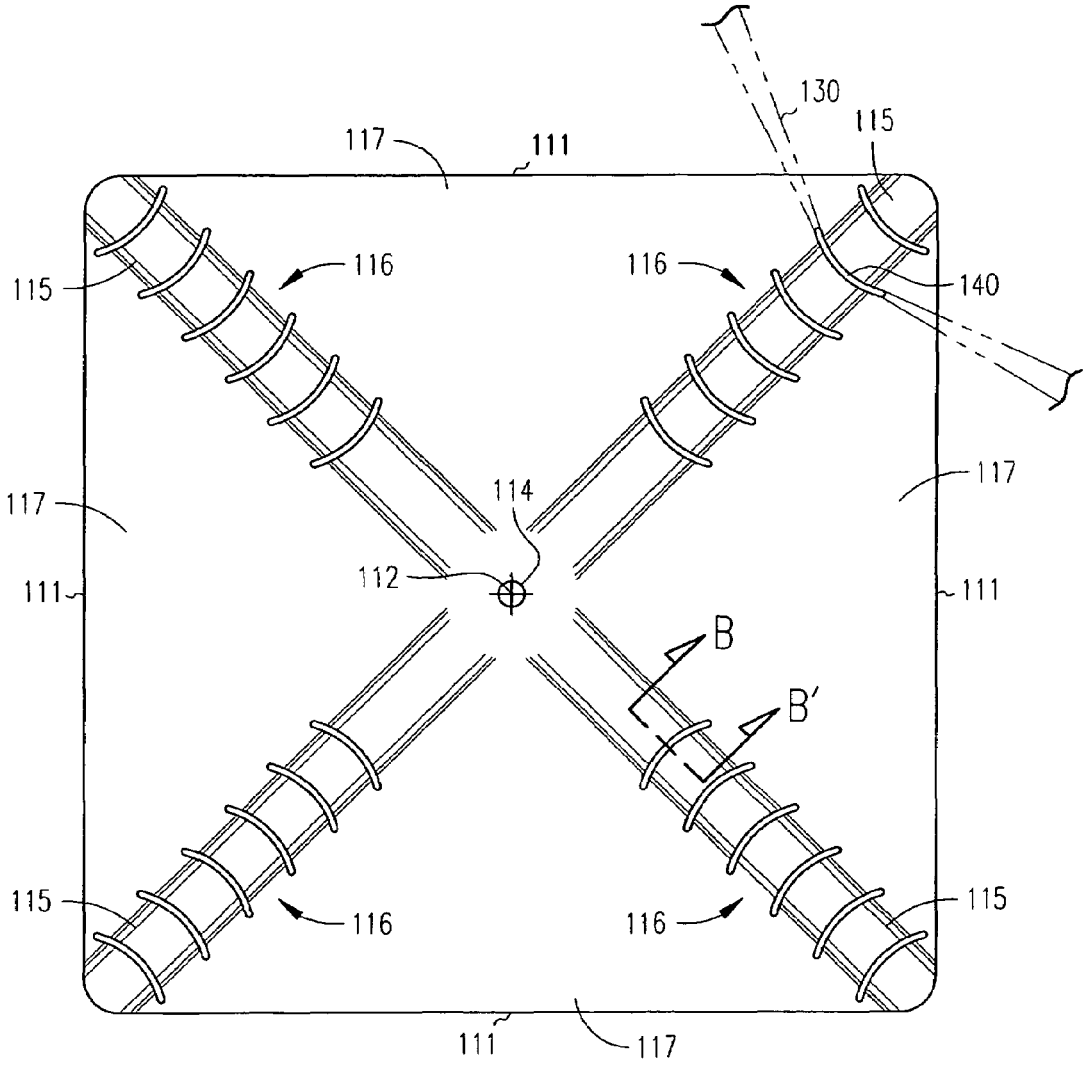
FIG. 2 is a top plan of the document holder of FIG. 1, turned 45° from FIG. 1.

FIGS. 1 and 2 show an example embodiment of a multiple document holder 100 for placement on a horizontal surface similar to a desktop, for example a credenza, table, or counter. A body 110 has a pyramidal shape. The term "pyramidal" here refers to an object that has the general overall form of a pyramid having any number of faces, including those having one or more variations such as truncated tops, rounded edges, curved faces, irregular polygonal cross sections, and solid or hollow interiors, possibly missing a bottom face or parts of other faces not directly engaged in holding documents.

The bottom of body 110 is substantially straight, and is adapted to rest, either directly or indirectly, on a horizontal surface such as a desk (not shown). Bottom edges 111 may be sharp or rounded. Vertex 112 of body 110 may be sharp or rounded. Central axis 114 defines a vertical direction. Side edges 115 slant upwardly toward axis 114. Edges 115 may be sharp or rounded as desired for a pleasing appearance.

At least some of the side edges 115 carry banks 116 of curved slots or pockets for holding documents. The term "document" includes one or more sheets having a thickness relatively small compared to its length or width; for example, a document may comprise 1–20 or so sheets of 20# bond or similar letter-size paper. The size and material of a document render it flexible enough to bend significantly if held in a relatively small area of the document, yet strong enough to resist bending if a curve is imparted to it; that is, even though it may be incapable of retaining its shape under its own weight unless curved. The direction of the curve is shown as away from axis 114, although an opposite curvature is also possible. A document may contain printing or other indicia on one or both sides, may display some other information such as color or shape, or may be blank. Dashed lines 130 schematically indicate a document 130 held in a typical slot 140 in an edge 115 of body 110. A document such as 130 may be one or more sheets of paper, plastic, or other material having a thickness and flexibility capable of fitting into slot 140. The number of slots in each bank depends upon the size of the documents, the desired amount of each document desired to be visible from a viewing position, the overall size of holder 100, and other factors. Not all of the banks need have the same number of slots, and some may have no slots at all, or be reserved for other purposes. The slots are spaced far enough apart on edges 115 to allow the documents to be identified, yet close enough to accommodate a sufficient number of documents to be viewed at once. The slots may begin near the bottom of the body, and may extend toward vertex 112 until the documents in adjacent banks 116 begin to interfere with each other.

Figure 3:
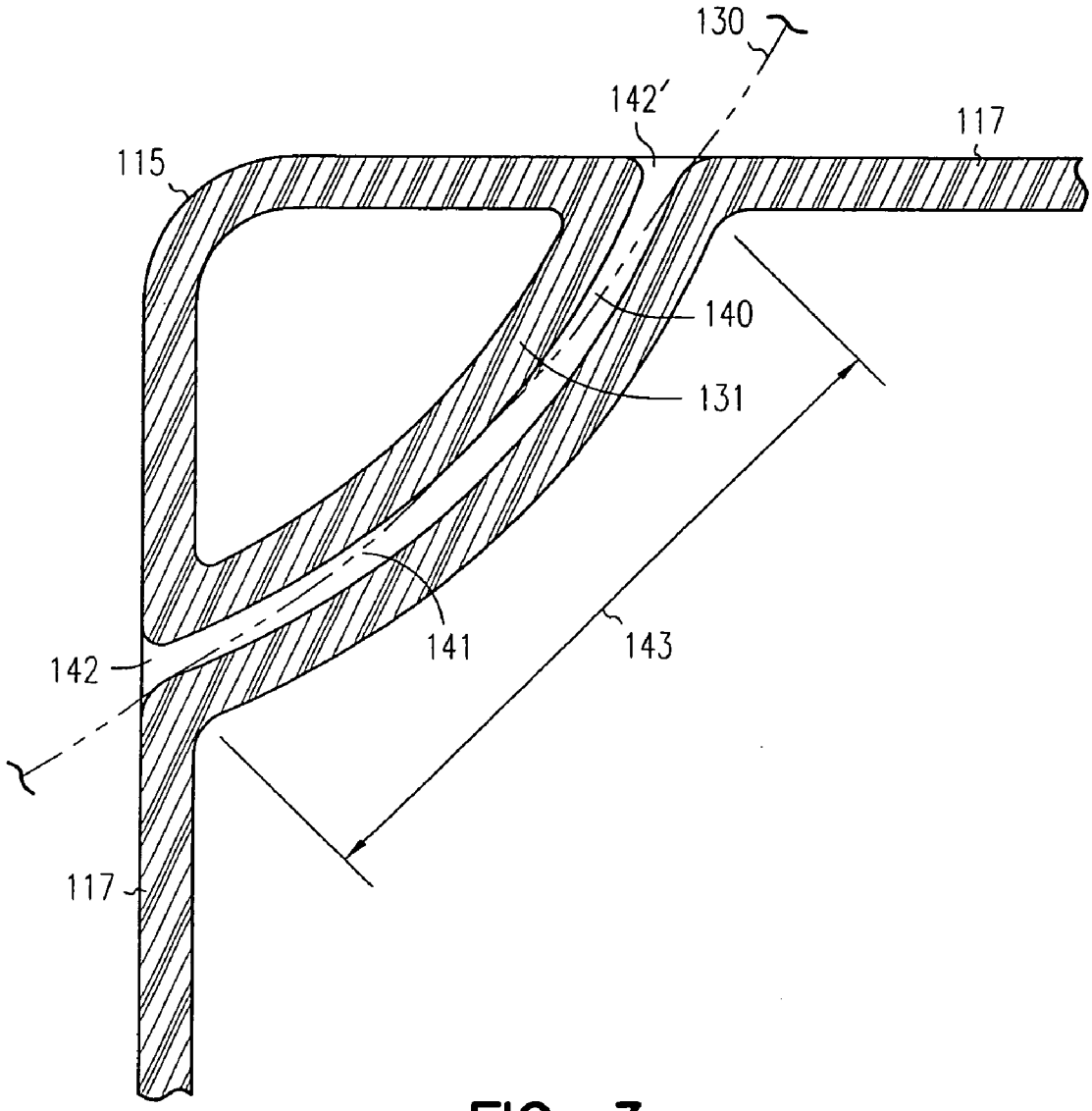
FIG. 3 is a cross section taken at line A–A' of FIG. 1.
Figure 4:
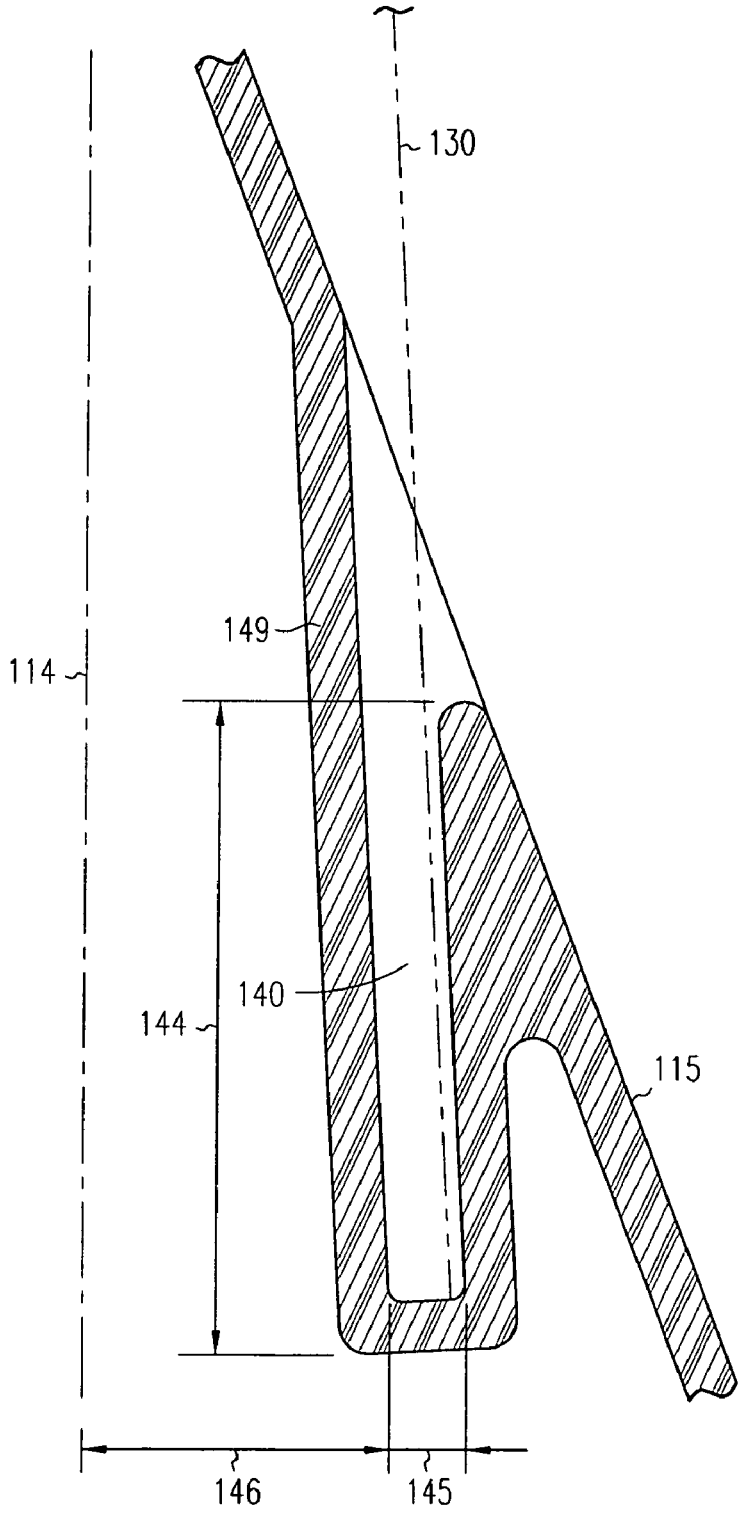
FIG. 4 is a cross section taken at line B–B' of FIG. 2.

FIGS. 3 and 4 show a typical slot 140 in horizontal and vertical coss sections taken along lines A–A' and B–B' of FIGS. 1 and 2. FIGS. 3 and 4 illustrate a body 110 made of molded plastic or similar relatively thin material, where slots such as 140 are molded into the edges 115 and/or parts of side faces 117. FIG. 3 shows a horizontal curve 141 in slot 140 for forcing document 130 to assume a horizontal curve 131 in the portion of the document width located within slot 140. Curve 141 forces a part of the width of the document into a vertical curve sufficient to prevent it from bending in a vertical direction enough to fall over. Curve 141 also provides friction by loosely clamping the document between its front and rear walls; this effect helps to prevent the document from falling sideways out of slot 140. The portions of the document width outside slot 140 normally remain straight, if the document was flat before being placed in the slot. Although FIGS. 3 and 4 show a constant arc between ends 142 and 142', a different portion of the slot's width may be curved at different angles and/or radii, and some portions may have no curvature at all in the horizontal plane. Also, different slots may have different curvatures.

Higher slot curvature provides more bending and tipping resistance, and allows placing documents in adjacent banks closer together without interference. (The end of a document being held in a curved slot, or in the hand, curves more than the free opposite end, as shown by dashed lines 130 in FIGS.

1 and 2. Thus, a high curvature applied only near the bottom center of a document still presents the top of a letter-size document in a gentler curve for better viewing. But a very high curvature may require the user to fold the top of a document almost double when holding the upper end in the hand in order to insert its lower end into a slot.) Less curvature flattens the tops of the documents more for easier viewing, and allows easier insertion of documents into the slots, but also decreases the holding power of the slots.

Slot 140 maintains document 130 in an upright position, to prevent it from easily flopping over in a horizontal direction and from easily tipping sideways out of the slot. Achieving this result depends upon curvature and other parameters of the slot 140, as well as upon characteristics of document 130. Slot curvature parameters may include its radius and arc angle; other slot parameters may include its end-to-end width 143, its depth 144, thickness 145, and the vertical angle 146 between slot 140 and the direction of vertical axis 114, FIG. 1. These parameters operate both alone and in combination with each other and in combination with the characteristics of document 130. Relevant document characteristics may include the flexibility or stiffness of its material, its sheet thickness or number of sheets, and/or its shape. The frictional coefficients of the document and the slot material also have some effect.

In many applications, document 130 should be readable or visible from viewing angles such as 101, FIG. 1. That is, a user views documents from an angle that is anywhere from substantially horizontal (parallel to bottom edges 111) to about 30–40 degrees above the horizontal. For this reason, slots 140 may be nearly vertical or slanted upwardly back from the vertical; that is the slots may be tilted upwardly toward vertical axis 114, so that a viewer sees them more nearly perpendicularly.

Body 110 may be fabricated from a number of different materials. Office-supply stores commonly carry low-cost plastic trays, pencil holders and similar items in clear and black, as well as smoky translucent gray, for desktop use, although any color—or multiple colors—is suitable. Molding body 110, including slot banks 116, of this type of acrylic or similar plastic provides a pleasing appearance that is inexpensive and compatible with other desk accessories. In this case, the rear and bottom walls may be formed as pouches 149 in adjacent faces 117 where they meet at an edge 115. Alternatively, an oiled or other finished wood provides a more luxurious appearance.

Figure 5:
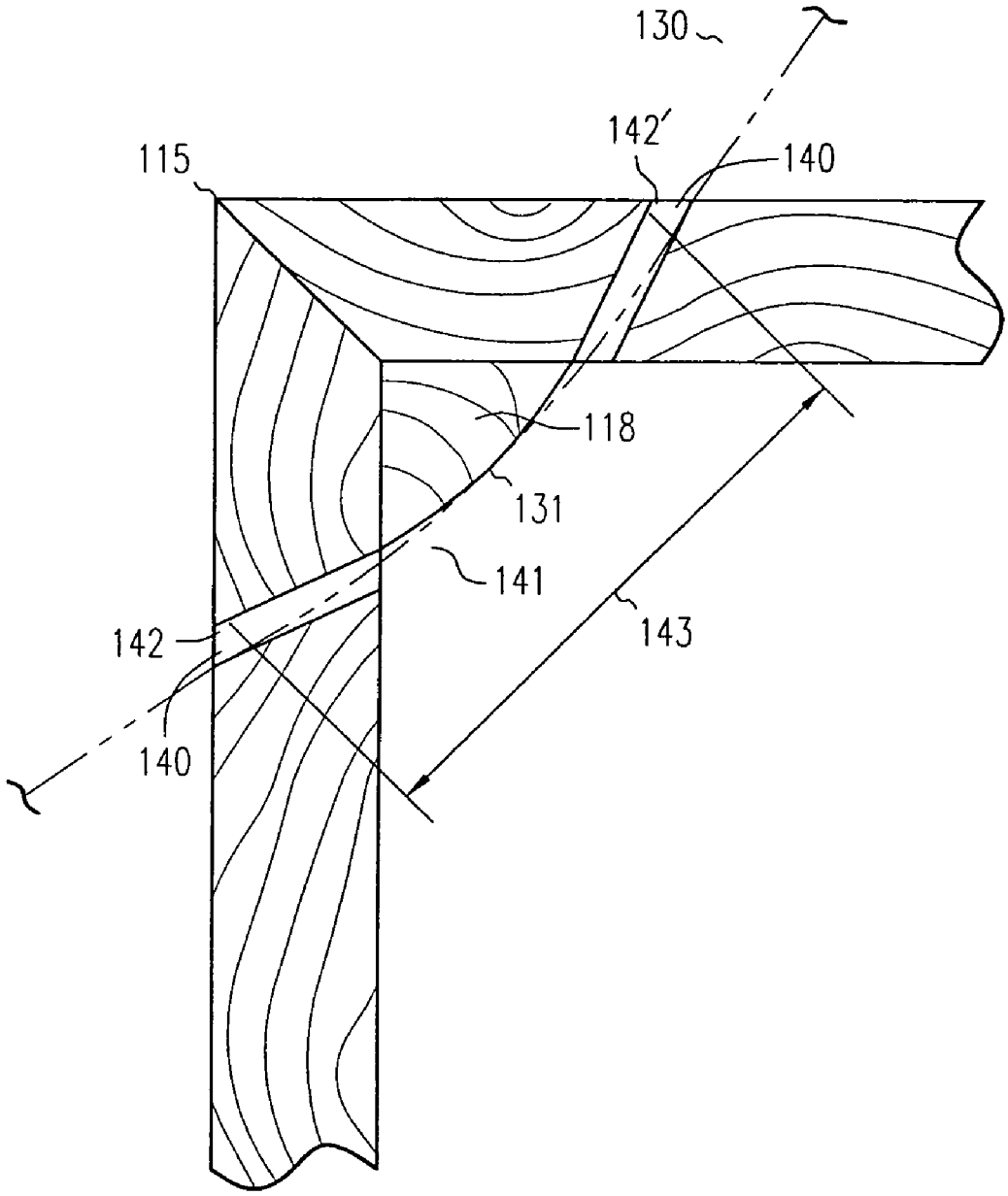
FIG. 5 is a cross section of another embodiment, taken at line A–A' of FIG. 1.
Figure 6:
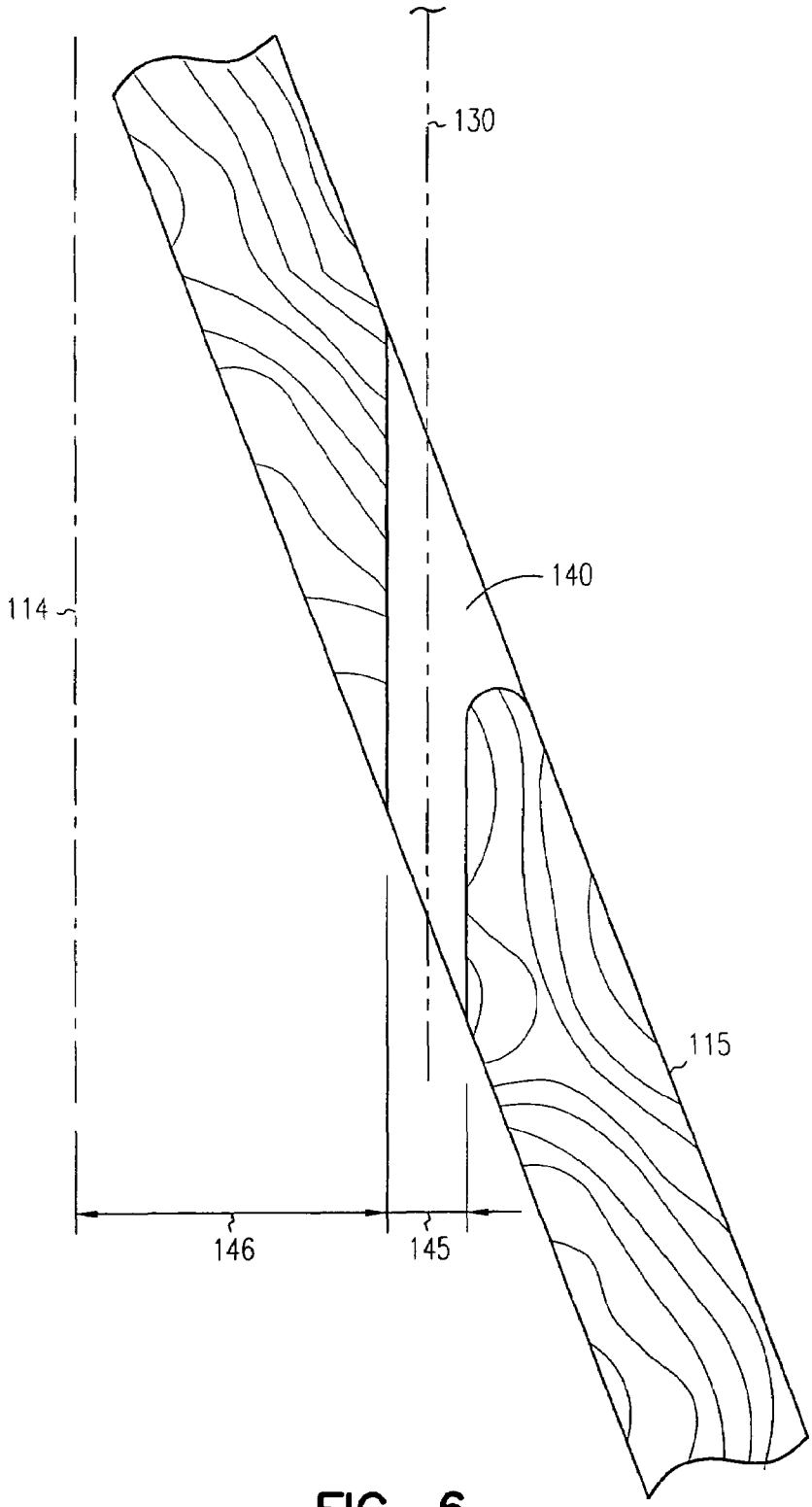
FIG. 6 is a cross section of the embodiment of FIG. 5, taken at line B–B' of FIG. 2.

FIGS. 5 and 6 show cross sections along lines A–A' and B–B' of FIGS. 1 and 2 for a wood body 110. Oiled or other finished wood imparts a luxurious appearance, and may carry ornamentation or logos (not shown) for a personalized touch. Such a body may be fabricated in many different ways. For example, each vertical face 117 may comprise a separate piece, with a conventional miter joint 153 at edges 115. If the material is thick enough, slots 140 may be cut or otherwise formed entirely within pieces 151 and 152. Here again, slot 140 holds a document such as 130 bent in a horizontal curve having its interior facing away from the center of the body and slanted upwardly toward the center of body 110, that is, toward axis 114, FIG. 1. In this embodiment, two noncontiguous straight segments 154, 155 set at an angle to each other form the slot 140 and provide the curve or arc required to force document 130 into a vertical outward curve needed to restrain it against bending horizontally and to steady it against tipping sideways out of the slot. An internal brace 118 in body 110 may reinforce side edge 115; such a brace could be made thicker, and also serve as a wall of slot 140, if desired to further enforce curvature of document 130.

Figure 7:
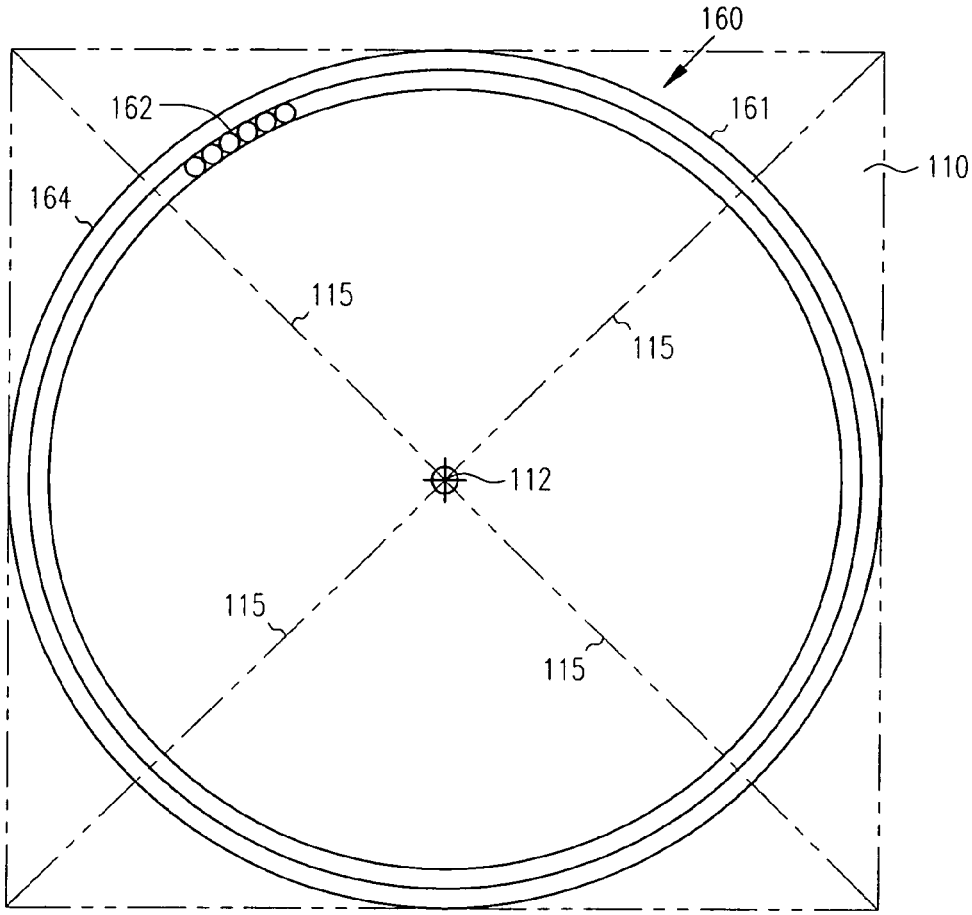
FIG. 7 is a top plan of a base for a document holder.

FIG. 1 shows body 110 mounted on a horizontal base 160 for resting on a horizontal surface (not shown) such as a desk or table. Base 160 may simply comprise a flat piece of plastic, wood, or other suitable material 161 fixedly attached to body 110; in some settings, the base may simply be the lower edges 111 of the body itself, possibly with feet (not shown) to avoid marring or scratching. However, a rotation or swivel mechanism that allows body 110 to rotate in a horizontal plane increases the utility of holder 100 in many applications by allowing a user to see documents in all the banks 116 without changing the user's position. In FIG. 1, base 160 fits inside body 110, only extending outside enough that lower edges 111 clear the surface that holder 100 rests upon. FIG. 7 illustrates a representative form of rotation mechanism 162 that mounts body 110 on base 160. In this example, rotation mechanism 162 is a circular ball-bearing racetrack that engages the lower part of body 110 (shown simplified in phantom in FIG. 7) to provide a smooth and relatively noiseless rotation of body 110. If base 160 and racetrack 162 are about the same width as body 110, the racetrack may engage walls 117 near lower edges 111 only near their midpoints. This avoids the necessity for a solid bottom surface on body 110, and thereby eases fabrication. In some embodiments, a racetrack could be incorporated directly into the mold for the plastic body shown in FIG. 5, or attached to the wooden body of FIG. 6, perhaps even without a separate base. In other embodiments, a flat plastic, metal, or wooden base could carry the racetrack. Other known mechanisms, such as a pivot or spindle (not shown) at the center of base 160 and attached along walls 117, or at vertex 112, may serve in some settings.

Different applications of holder 100 may call for different dimensions for a number of parameters of the holder. A representative design proposes a holder 100 for displaying large (e.g., letter-size, 8½×11 inch or A4) documents of one to about ten sheets on a desk, roughly one to three feet away from a seated user.

In this example, body 110 is a four-sided full pyramid. All of the following dimensions are approximate. Base edges 111 may be 10–14 inches long, with side edges 115 of 12–18 inches; in the specific example shown in FIGS. 1 and 2, both the base edges and the side edges are about 12 inches long. Four to seven or so slotsl4O on each of the four edges are spaced about 1½ inches apart; slot spacing of 1–2 inches generally exposes enough of a letter-size document for viewing purposes. The slots may extend about two-thirds the length of edges 115 before the documents in adjacent banks 116 begin to interfere with each other when placed in the slots. This distance depends upon the document size, and also upon the amount of curvature imparted by slots 140.

Each slot 140 may be canted or tilted slightly from the vertical of axis 114 in a backward direction-i.e., in the same direction from the vertical as edges 115. Although tilt angles from 0–20° are satisfactory, the example shown employs angles from 5–12° for typical desk heights and viewing distances. Slots 140 may have a length 143 in the range of 1–2½ inches (here about 2 inches), a depth 144 of 1–2 inches (here 1¼ inches), width or throat 145 of about 0.1 inch.

An arc angle of 90–160° serves to prevent a document 130 of 1–20 sheets typical weight (say, 20–60#) paper from falling out of the slot sideways, from bending over vertically, and from interfering with documents in adjacent banks 116. As shown especially in FIG. 3, the rear wall of slot 140 may be longer than the front wall. Also, the top of slot 140 may be curved and/or slightly wider than its bottom, for ease of placing documents into the slots. Base 160 may be substantially circular, and about ¼–1 inch thick, possibly padded with felt or other material 164 to prevent scratching the surface upon which it rests, and possibly extending upwardly into body 110, so that it is substantially concealed from the viewer. A rubberized or other non-skid surface—such as feet 164—and/or a heavy or weighted base 160 may also reduce sliding when documents are inserted into or removed from holder 100.

The described example holder 100 may be molded of 0.07–0.15 inch acrylic or other suitable plastic. Clear, smoked, or black colors match other commonly available desk accessories, but any color is satisfactory. In this case, edges 115 may be softly radiused, say at ¼–¾ inches. Alternatively, holder 100 may be fashioned from ¼–1 inch thick wood. Oiled walnut or mahogany ¾-inch thick faces 117 present a rich appearance. In this example, cosmetic aspects might call for relatively sharp edges 115, or radiusing less than ¼ inch or so. Faces 117 may be mitered and glued, and slots 140 cut into them at edges 115. As noted in connection with FIG. 5, such slots may actually comprise straight cuts at an angle of 110–150° from each other. A ¾ inch finished wooden base may have the same width or diameter as body 110. A thinner heavy steel base of slightly less diameter would hide its presence under body 110 and present a floating appearance. This form of holder 100 may be heavy enough in itself to keep it from sliding on a desktop in normal use, without additional weighting and/or friction material.

Some of the factors for choosing particular dimensions involve stiffening a document against bending over toward the base of body 110, restraining it against easily tipping sideways out of the slot, allowing enough of the document to be visible from a desired viewing position, spacing banks 116 far enough apart in a horizontal direction to prevent documents in adjacent banks from interfering with each other and to facilitate document insertion and removal. These and other parameters interact with each other in designing a holder 100 for a particular environment.

Conclusion

The foregoing description and drawing figures illustrate various embodiments and aspects sufficiently to enable those skilled in the art to practice the invention. Other embodiments may incorporate structural, process, and other changes. Examples merely typify possible variations, and are not limiting. Individual components and functions are optional unless explicitly required. Portions and features of some embodiments may be included in, substituted for, or added to those of others. The Abstract is provided only as a search tool, and not for claim interpretation. The scope of the invention encompasses the full ambit of the claims and all available equivalents.

What is claimed is:

1. A holder for multiple documents, comprising:

a base for resting on a substantially horizontal surface;

a pyramidal body having a vertical axis and a number of upwardly slanting edges; and multiple slots in at least some of the slanting edges, each of the slots facing upwardly, slanted upwardly toward the vertical axis, and being curved in a horizontal direction with respect to the vertical axis to provide friction for holding one of the documents.

2. The holder of claim 1 where the slots are curved-to prevent the documents from bending over in a vertical direction.

3. The holder of claim 2 where the slots are curved so as to aid in preventing the documents from tipping sideways.

4. The holder of claim 1 where the base includes a piece separate from the body.

5. The holder of claim 4 further including a rotation mechanism for rotating the body relative to the base piece.

6. The holder of claim 5 where the rotation mechanism includes a ball-bearing racetrack.

7. The holder of claim 1 further comprising a number of faces extending at least partially between all adjacent ones of the upwardly slanting edges.

8. The holder of claim 1 further comprising a number of faces extending continuously between all adjacent ones of the upwardly slanting edges.

9. A holder for multiple documents, comprising:

a base for resting on a substantially horizontal surface;

a pyramidal body having a vertical axis and a number of upwardly slanting edges; and multiple slots in at least some of the slanting edges, each of the slots being curved in a horizontal direction for holding one of the documents, where the slots are curved outwardly in a horizontal direction with respect to the vertical axis of the body to provide friction to prevent the documents from bending over in a vertical direction, where the slots are slanted upwardly toward the vertical axis of the body.

10. A desktop document holder, comprising:

a base for contacting a horizontal surface;

a pyramidal body including a vertical axis and a number of upwardly slanting edges of length in the approximate range of 14 to 17 inches;

banks of at least 4 slots in at least some of the edges, each of the slots being curved outwardly from the vertical axis in a horizontal direction and tilted upwardly toward the vertical axis for holding one of the documents, the banks being spaced apart sufficiently to avoid interference between documents in adjacent banks; and a rotation mechanism for rotating the body with respect to the base.

11. The holder of claim 10 where the slots subtend an arc of about 110–150°.

12. The holder of claim 11 where the slots have a length of about 1–2½ inches.

13. The holder of claim 11 where the slots have a width of about 0.1 inch.

14. The holder of claim 11 where the slot have a depth of about 1–2 inches.

15. The holder of claim 10 where the slots tilt less than about 20° from the vertical axis.

16. The holder of claim 15 where the slots tilt about 5–12° from the vertical axis.

17. The holder of claim 10 where the body is made of molded plastic.

18. The holder of claim 17 where the upwardly slanting edges are radiused.

19. The holder of claim 10 where the body is made of jointed wood faces.

20. The holder of claim 10 where the base is substantially circular.

21. The holder of claim 20 where the base is approximately the same width as the body.

22. A holder for multiple documents, comprising:

a base for resting on a substantially horizontal surface;

a pyramidal body having a vertical axis and four upwardly slanting edges; and multiple slots in at least some of the slanting edges, each of the slots being slanted upwardly toward the vertical axis of the body, and being curved in a horizontal direction with respect to the axis to provide friction for holding one of the documents.

* * * * *